US010835098B2

(12) United States Patent
Disch et al.

(10) Patent No.: US 10,835,098 B2
(45) Date of Patent: Nov. 17, 2020

(54) CONVEYOR DISHWASHER AND METHOD FOR OPERATING A CONVEYOR DISHWASHER

(71) Applicant: ILLINOIS TOOL WORKS INC., Glenview, IL (US)

(72) Inventors: Harald Disch, Elzach (DE); Philipp Klumpp, Lahr (DE); Markus Heidt, Kehl (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 176 days.

(21) Appl. No.: 15/747,901

(22) PCT Filed: Jul. 22, 2016

(86) PCT No.: PCT/US2016/043473
§ 371 (c)(1),
(2) Date: Jan. 26, 2018

(87) PCT Pub. No.: WO2017/019477
PCT Pub. Date: Feb. 2, 2017

(65) Prior Publication Data

US 2018/0213999 A1 Aug. 2, 2018

(30) Foreign Application Priority Data

Jul. 28, 2015 (DE) ..... 10 2015 214 300

(51) Int. Cl.
*A47L 15/24* (2006.01)

(52) U.S. Cl.
CPC ..... *A47L 15/248* (2013.01); *A47L 15/241* (2013.01); *A47L 15/247* (2013.01);
(Continued)

(58) Field of Classification Search
CPC .... A47L 15/248; A47L 15/241; A47L 15/247; A47L 2401/04; A47L 2401/20; A47L 2401/30; A47L 2401/24
See application file for complete search history.

(56) References Cited

U.S. PATENT DOCUMENTS 4,561,904 A 12/1985 Eberhardt

FOREIGN PATENT DOCUMENTS

CN 102119059 7/2011
CN 102123647 7/2011
(Continued)

OTHER PUBLICATIONS

PCT, International Search Report and Written Opinion, International Application No. PCT/US2016/043473; dated Oct. 21, 2016, 16 pages.

*Primary Examiner* — Tinsae B Ayalew
(74) *Attorney, Agent, or Firm* — Thompson Hine LLP

(57) ABSTRACT

A flight-type dishwasher or rack conveyor dishwasher has a conveyor apparatus (20) for conveying washware through individual treatment zones (11, 12, 13, 14, 15) of the conveyor dishwasher (1). The conveyor dishwasher (1) has a detection system (30) designed to detect the presence of washware or a washware carrier (7) in a predefined region (A) at an inlet (10) or at a feed (16) of the conveyor dishwasher (1). A control device (50) is designed to actuate the conveyor apparatus (20) such that the conveyor apparatus (20) is activated when washware or a washware carrier (7) is detected in the region (A) at the inlet (10) or feed (16) of the conveyor dishwasher (1), and that the conveyor apparatus (20) is deactivated when no washware or no washware carrier (7) is detected in the region (A) at the inlet (10) or feed (16) of the conveyor dishwasher (1).

18 Claims, 2 Drawing Sheets

Figure 1:
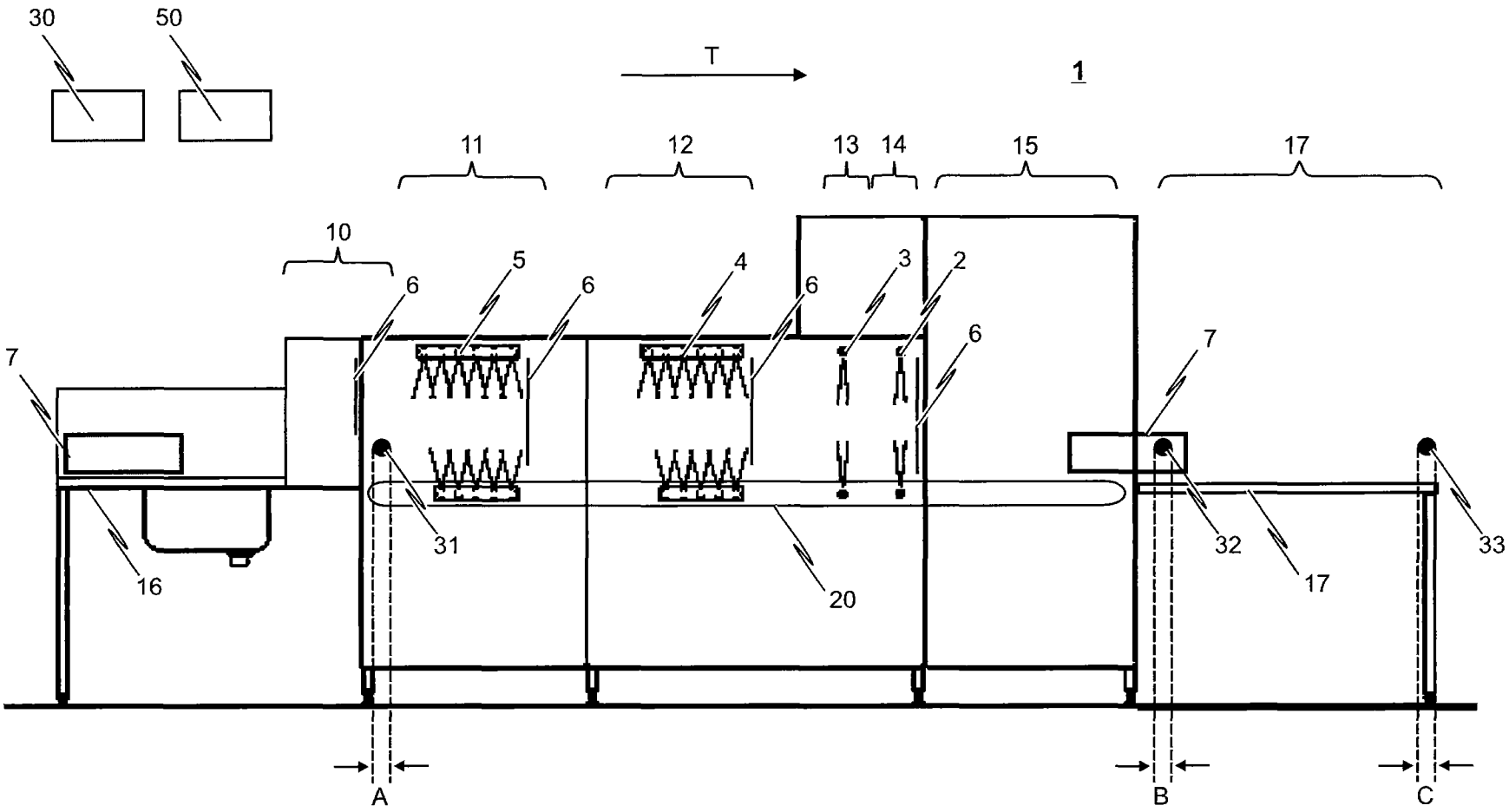

(52) U.S. Cl.
CPC ..... *A47L 2401/04* (2013.01); *A47L 2401/20* (2013.01); *A47L 2401/30* (2013.01); *A47L 2501/24* (2013.01)

(56) References Cited

FOREIGN PATENT DOCUMENTS

| | | | |
|---|---|---|---|
| CN | 103189884 | | 7/2013 |
| CN | 103619229 | | 3/2014 |
| CN | 204137817 | | 2/2015 |
| CN | 104386487 | | 3/2015 |
| DE | 69525337 | T2 | 3/2003 |
| DE | 102013226080 | A1 | 6/2015 |
| EP | 2335546 | | 6/2011 |
| GB | 2087717 | | 6/1982 |
| IT | 1149371 | | 12/1986 |
| JP | H08113355 | | 5/1996 |
| WO | WO 83/01187 | | 4/1983 |
| WO | WO 95/29625 | | 11/1995 |
| WO | WO 00/53076 | | 9/2000 |

CONVEYOR DISHWASHER AND METHOD FOR OPERATING A CONVEYOR DISHWASHER

The present invention relates to a commercial conveyor dishwasher which is designed as a flight-type dishwasher or rack conveyor dishwasher, and has a conveyor apparatus for conveying washware through the individual treatment zones of the conveyor dishwasher.

Conveyor dishwashers of this kind generally have at least one wash zone in which wash liquid from a wash tank which is associated with the wash zone is sprayed onto the washware. Furthermore, at least one final rinse zone which is arranged downstream of the at least one wash zone as seen in the conveying direction of the washware and in which final rinse liquid is sprayed onto the washware is generally provided. Conveyor dishwashers of this kind often also have a waste air system in order to discharge waste air, which is produced during operation of the machine, from the conveyor dishwasher.

A conveyor dishwasher of the kind cited in the introductory part is known, in principle, from the prior art and is usually used in the commercial sector. In contrast to so-called box-type dishwashers in which the washware to be washed remains stationary in the machine during washing, the washware is conveyed through various treatment zones of the conveyor dishwasher in the case of conveyor dishwashers.

A conveyor dishwasher usually has at least one pre-wash zone and at least one main-wash zone as treatment zones, said main-wash zone being arranged downstream of the pre-wash zone(s) as seen in the conveying direction of the washware. At least one final rinse zone is generally arranged downstream of the main-wash zone(s) as seen in the conveying direction.

It is also known to further provide at least one post-wash zone or pre-rinse zone between the main-wash zone and the final rinse zone.

As seen in the conveying direction of the washware, the washware which is held either directly on a conveyor belt or the washware which is held by washware carriers, in particular dish racks, usually runs through an inlet tunnel, the pre-wash zone(s) which adjoin said entry tunnel, main-wash zone(s), post-wash zone(s) which may be provided, final rinse zone(s) and a drying zone, into an outlet section.

Said wash zones (pre-wash zone(s), main-wash zone(s) and post-wash zone(s) which may be provided) of the conveyor dishwasher each have an associated wash system which has a wash pump and a line system which is connected to the wash pump and by means of which wash liquid is supplied to corresponding spray nozzles of the wash zones. The wash liquid which is supplied to the spray nozzles is sprayed onto the washware, which is conveyed from a conveyor apparatus of the conveyor dishwasher through the respective wash zones, in the respective wash zone.

A wash tank in which sprayed liquid is accommodated and/or in which liquid for the spray nozzles of the relevant zones is provided is associated with each wash zone.

In a conveyor dishwasher of the kind cited in the introductory part, final rinse liquid in the form of fresh water which can be pure or admixed with further additives, such as final rinse aid for example, is sprayed onto the washware by means of the spray nozzles of the final rinse zone. At least some of the sprayed final rinse liquid is conveyed from treatment zone to treatment zone against the conveying direction of the washware by means of a cascade system.

The sprayed final rinse liquid is collected in a tank (post-wash tank) of the post-wash zone, from which it is conveyed to the spray nozzles (post-wash nozzles) of the post-wash zone by means of the wash pump of the wash system which is part of the post-wash zone. In the post-wash zone, wash liquid is rinsed off from the washware. The liquid which is produced in the process flows into the wash tank of the at least one main-wash zone which is arranged upstream of the post-wash zone as seen in the conveying direction of the washware. Here, the liquid is usually provided with a detergent and is sprayed onto the washware by a pump system (wash pump system), which is part of the wash system of the main-wash zone, by means of the nozzles (wash nozzles) of the main-wash zone.

If no further main-wash zone is provided, the liquid then flows from the wash tank of the main-wash zone into the pre-wash tank of the pre-wash zone. The liquid in the pre-wash tank is sprayed onto the washware by way of a pump system, which is part of the wash system of the pre-wash zone, by means of the pre-wash nozzles of the pre-wash zone in order to remove coarse dirt from the washware.

A conveyor dishwasher (conveyor warewasher) according to the present invention is, in particular, a flight-type dishwasher (flight-type warewasher) or a rack conveyor dishwasher (rack conveyor warewasher).

Conveyor dishwashers of the kind taken into consideration in this document are generally used in sculleries in which a large number of items of washware are to be washed per hour. In contrast to manually loaded box-type dishwashers, conveyor dishwashers form the only actually sensible solution for applications of this kind from an economical point of view.

Conveyor dishwashers transport the washware through individual treatment zones of the machine in two different ways: in rack conveyor dishwashers, the items of washware move through the individual treatment zones of the machine in washware carriers, in particular in dish racks. In flight-type dishwashers however, the washware is sorted into finger conveyor belts or universal conveyor belts. Rack conveyor dishwashers can be realized with a capacity of up to approximately 5400 plates required to be cleaned per hour. Flight-type dishwashers for their part are suitable for a dishwashing output starting from approximately 1700 plates per hour. There is a capacity window in which both a rack conveyor dishwasher and a flight-type dishwasher would be feasible from an economical point of view between said two dishwashing outputs.

When planning sculleries and making the decision as to whether a flight-type dishwasher or a rack conveyor dishwasher should be selected for a scullery, in particular from an economical point of view, it is necessary, in particular, to take into account whether enough dishwashing personnel are available or can be employed in the scullery.

A flight-type dishwasher generally requires, in principle, at least two people to operate it since, during operation of the machine, the washware which is to be washed has to be manually sorted into the finger conveyor belt or universal conveyor belt in the inlet region of the flight-type dishwasher by at least one member of dishwashing staff while at least one further member of dishwashing staff has to remove the washed washware from the finger conveyor belt or universal conveyor belt in the outlet region of the flight-type dishwasher at the same time.

However, a rack conveyor dishwasher can—at least in principle—also be at least temporarily operated by only one single member of dishwashing staff since—in contrast to a flight-type dishwasher—a rack conveyor dishwasher is loaded "in batches", specifically by the washware which is to be washed—placed in a washware carrier (for example dish racks)—being supplied to the inlet region of the dishwasher, and, with a time delay, after the washware carrier has run through the individual treatment zones of the dishwasher, the member of dishwashing staff can then remove the washware carrier containing the washed washware from the dishwasher again.

However, even when operating rack conveyor dishwashers, in particular in the case of operation by only a single member of dishwashing staff, it is generally not possible to avoid the dishwasher being loaded with washware carriers in an irregular manner in respect of time.

Irregular loading of this kind could (at least in principle) be counteracted by more than only one single member of dishwashing staff being intended to operate a rack conveyor dishwasher. However, owing to a fluctuating number of dishwashing staff often actually being available, it not being possible to avoid this in practice, it is impossible to avoid the situation of—at least on average over time—a rack conveyor dishwasher generally not being operated in a manner in which it is actually optimally utilized, this having a negative effect on the running costs during operation of a dishwasher of this kind.

In practice, the usual approaches and procedures known from the prior art result in spaces of approximately 30 to 40% between the individual washware carriers or dish racks during operation of a conveyor dishwasher which is designed, in particular, in the form of a rack conveyor dishwasher. These spaces could even lie in the region of 50% or even more when operating with only one single member of dishwashing staff.

The term "space" or "spaces" used in this document are intended to be understood to mean regions which are free of washware or free of washware carriers and which are created during operation of a conveyor dishwasher when washware or washware carriers (for example dish racks) is/are conveyed through the individual treatment zones of the machine. Regions of this kind which are free of washware or washware carriers reduce the dishwashing capacity of the machine which is actually implemented, even if the machine is designed, in principle, to wash washware continuously in respect of time without the presence of any regions which are free of washware or free of washware carriers.

This has the result that it is generally not possible to treat the maximum number of dish racks which can potentially be treated per unit time in the treatment zones of the machine during actual operation of a conveyor dishwasher. Particularly in the event of operation by only one single member of dishwashing staff, this has the result that said member of dishwashing staff has to alternate between the loading region and unloading region of the conveyor dishwasher a greater number of times for the same number of washware carriers. This increases the amount of movement.

Proceeding from this problem, the invention is based on the object of developing a conveyor dishwasher of the kind cited in the introductory part to the effect that it is possible to efficiently utilize the machine even in the event of operation by only one single member of dishwashing staff. According to a further object on which the invention is based, the conveyor dishwasher should also be designed to allow operation which is as efficient and fluid as possible in the event of operation by two or more members of dishwashing staff.

Furthermore, the invention is intended to specify a corresponding method for operating a conveyor dishwasher with which the problems outlined above can be solved.

In respect of the conveyor dishwasher, the problem on which the invention is based is solved by the subject matter of independent patent claim 1, and in respect of the method for operating a conveyor dishwasher, said problem is solved by the subject matter of coordinate patent claim 17, with advantageous developments of the invention being indicated in the corresponding dependent claims.

According to the invention, it is accordingly proposed to provide a detection system which is designed to detect the presence of washware in a predefined region at the inlet or at a feed of the conveyor dishwasher. The term "inlet" used in this document is intended to be understood to mean, in general, the inlet region of the conveyor dishwasher. Said inlet is, for example, the inlet tunnel of the conveyor dishwasher.

On the other hand, the term "feed" used in this document is intended to be understood to mean, in particular, a region of a feed table which may be provided at the inlet of the conveyor dishwasher. Said feed is, in particular, a region at the interface between a feed table which may be provided and the actual conveyor dishwasher.

A feed table of this kind is usually provided in order to load the washware carriers with washware and/or in order to perform pre-clearing, in particular manual pre-clearing. Pre-clearing of this kind makes sense in particular when the washware which is to be supplied to the dishwasher is contaminated to a greater or lesser extent by residues, serviettes, toothpicks etc. These contaminants should not be introduced into the detergent recirculation tank since otherwise the detergent solution (wash liquid) becomes too severely soiled.

According to the invention, a control device is further provided, said control device being designed to actuate the conveyor apparatus of the conveyor dishwasher in such a way that the conveyor apparatus is activated when washware is detected in the region at the inlet or feed of the conveyor dishwasher with the aid of the detection system. Furthermore, the controller is designed to deactivate the conveyor apparatus when no washware is detected in the region at the inlet or feed of the conveyor dishwasher.

The provision of a control device of this kind, which activates or deactivates the conveyor apparatus depending on the presence of washware which is detected with the aid of the detection system, advantageously has the result that the washware which is to be treated is transported through the individual treatment zones of the conveyor dishwasher only when washware which is to be washed is actually present at the entrance of the conveyor dishwasher, that is to say at the inlet or at the feed of the conveyor dishwasher.

In the one preferred development of the solution according to the invention, it is provided that the detection system is further designed to detect the presence of washware in a predefined region at the outlet of the conveyor dishwasher. In this embodiment, the control device is further designed to actuate the conveyor apparatus of the conveyor dishwasher depending on whether washware is present in the region at the outlet of the conveyor dishwasher. In this case, it is particularly preferably provided that the outlet of the conveyor dishwasher follows the conveyor apparatus—as seen in the conveying direction of the washware—, where the detection system is designed to detect the presence of washware in a predefined region of the outlet of the conveyor dishwasher.

The term "outlet of the conveyor dishwasher" used in this document is intended to be understood to mean that region which is situated downstream of the conveyor dishwasher as seen in the conveying direction of the washware and into which the washware which was previously treated in the individual treatment zones of the conveyor dishwasher is pushed with the aid of the conveyor apparatus after said washware passes through the individual treatment zones. Said outlet of the conveyor dishwasher is, in particular, an outlet table onto which the washware is pushed with the aid of the conveyor apparatus after said washware is treated in the treatment zones of the conveyor dishwasher.

It is essential in this case that the conveyor apparatus of the conveyor dishwasher is no longer active in the region of the outlet; in other words, washware which has been pushed into the outlet of the dishwasher comes to a stop in the outlet of the conveyor dishwasher in spite of the conveyor apparatus being activated.

The presence of washware is advantageously detected with the aid of the detection system in the region of the outlet of the conveyor dishwasher, that is to say in a region of the outlet in which the conveyor apparatus of the conveyor dishwasher is no longer directly active.

The outlet of the conveyor dishwasher is, in particular, an outlet table which is designed to receive a large number of washware units. The outlet table is generally dimensioned in such a way that at least two standard washware carriers can be received by the outlet table as seen in the conveying direction of the conveyor apparatus.

In respect of the positioning of the detection system for detecting the presence of washware, it is advantageous when said detection system is designed to detect the presence of washware in a region of the outlet which lies 0 to 500 mm, preferably 100 to 300 mm, downstream of the beginning of the outlet.

In a particularly preferred realization of the conveyor dishwasher according to the invention, the control device is designed, in a first operating state or operating mode of the conveyor dishwasher, to activate the conveyor apparatus, specifically independently of whether washware is present in the region at the inlet or feed of the conveyor dishwasher. Furthermore, the control device is designed, in a second operating state or operating mode of the conveyor dishwasher, to actuate the conveyor apparatus in such a way that the conveyor apparatus is activated when washware is detected in the region at the inlet or feed of the conveyor dishwasher and in the region at the or in the outlet of the conveyor dishwasher. Furthermore, the control device is designed to deactivate the conveyor apparatus when no washware is detected in the region at the inlet or feed of the conveyor dishwasher and washware is detected in the region at the or in the outlet of the conveyor dishwasher.

In a development of this realization, the control device is designed to automatically, preferably selectively automatically, switch over from the second operating state of the conveyor dishwasher to the first operating state when it is detected with the aid of the detection system that washware which was previously present at the or in the outlet of the conveyor dishwasher has been removed. As an alternative or in addition to this, the control device is designed, in the first and primarily in the second operating state of the conveyor dishwasher, to activate the conveyor apparatus when it is detected with the aid of the detection system that washware is present at the inlet or feed of the conveyor dishwasher.

In a preferred development of the last-mentioned realization of the conveyor dishwasher according to the invention, the detection device is further designed to additionally detect the presence of washware in a region which was predefined within the end region of the outlet. In other words, the detection system is designed to detect whether so much washware has already been pushed into the outlet of the conveyor dishwasher that the outlet is filled with washware, this being the case specifically when the washware which has been pushed into the outlet reaches the end region of the outlet.

In this preferred development, the control device is further designed to actuate the conveyor apparatus in such a way that, in the second operating state of the conveyor dishwasher, the conveyor apparatus is activated when washware is respectively detected in the region at the inlet or feed of the conveyor dishwasher and in the region at the or in the outlet of the conveyor dishwasher, and when no washware is detected in the region within the end region of the outlet of the dishwasher. Furthermore, the control device is designed to deactivate the conveyor apparatus when no washware is detected in the region at the inlet or feed of the conveyor dishwasher and washware is detected in the region at the or in the outlet of the conveyor dishwasher.

In a development of the last-mentioned embodiment, it is provided that the control device is further designed to actuate the conveyor apparatus in such a way that the conveyor apparatus is deactivated when washware is detected in the region within the end region of the outlet or when washware is respectively detected in the region at the or in the outlet of the conveyor dishwasher and in the region within the end region of the outlet.

Figure 2:
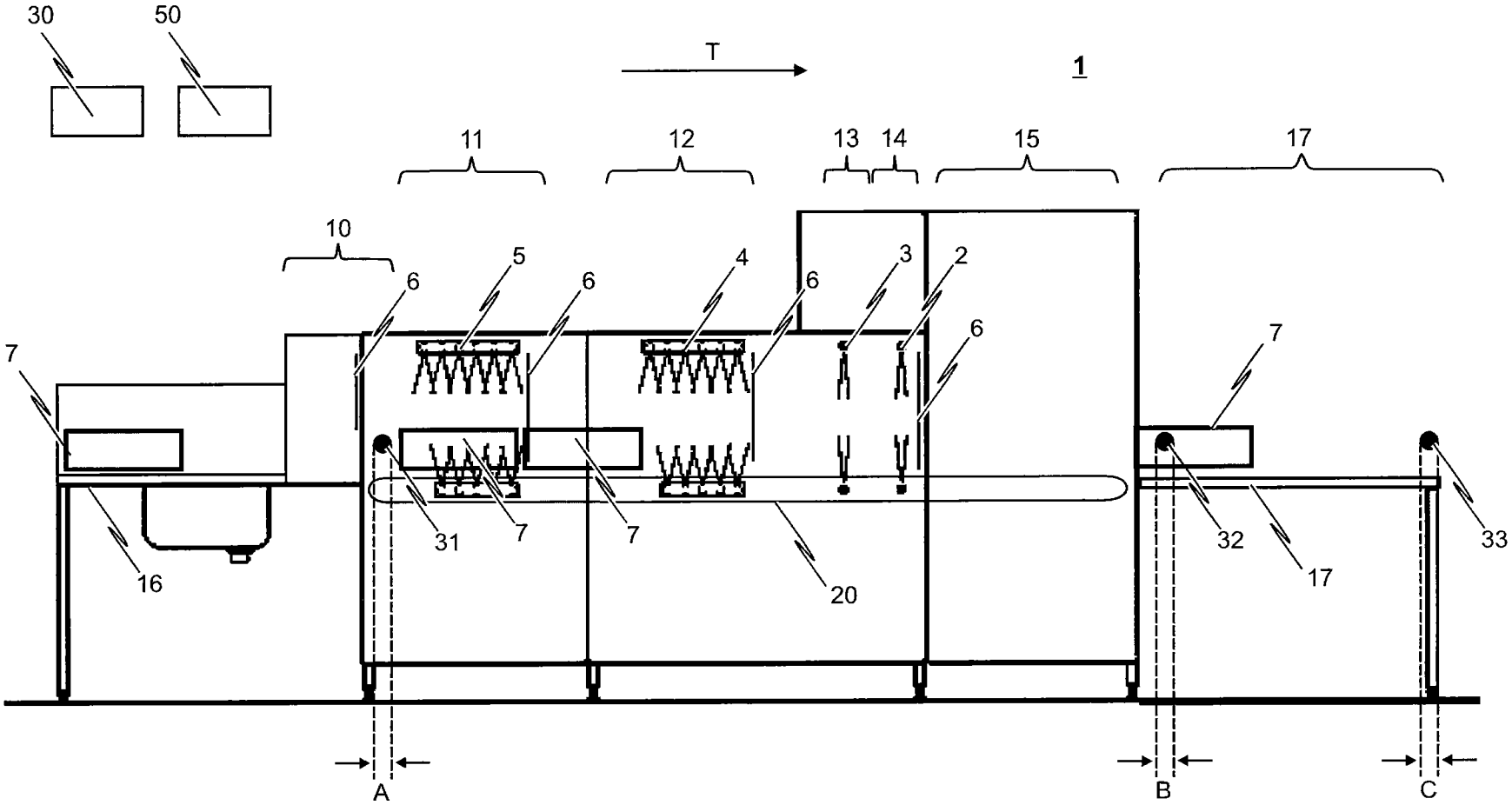

A purely exemplary embodiment of the conveyor dishwasher according to the invention will be described in greater detail below with reference to the appended drawings, in which:

FIG. 1 shows a schematic view of an exemplary embodiment of the conveyor dishwasher according to the invention at a first time during operation of the dishwasher; and FIG. 2 shows a schematic view of the exemplary embodiment of the conveyor dishwasher according to the invention in accordance with FIG. 1 at a later second time during operation of the dishwasher.

FIG. 1 shows a schematic longitudinal sectional view through a conveyor dishwasher 1 as an example of the solution according to the invention. The exemplary embodiment of the conveyor dishwasher 1 shown in FIG. 1 has a pre-wash zone 11 and a main-wash zone 12 which is arranged downstream of the pre-wash zone 11 as seen in the transportation direction T of the washware. As seen in the transportation direction T, a post-wash zone or pre-rinse zone 13 and a final rinse zone 14 are arranged downstream of the main-wash zone 12 in the case of the conveyor dishwasher 1 illustrated in FIG. 1.

As seen in the transportation direction T, the washware which is retained by washware carriers, in particular dish racks, in the case of the exemplary embodiment schematically illustrated in the drawings runs through an inlet tunnel 10, the following pre-wash zone 11, the main-wash zone 12, the post-wash or pre-rinse zone 13, the final rinse zone 14 and through a drying zone 15, into an outlet section 17.

The abovementioned treatment zones 11, 12, 13 and 14 of the conveyor dishwasher 1 each have associated spray nozzles by means of which liquid is sprayed onto the washware which is transported through the respective treatment zones 11, 12, 13, 14 by the conveyor belt.

As is schematically indicated in the drawings, it is preferred when the spray nozzles, for example of the wash system which is associated with the pre-wash zone 11 and the main-wash zone 12, are in each case formed in an upper and lower wash tube, and therefore corresponding wash arms are used in these treatment zones 11, 12. It is feasible here for the wash systems which are used to have a large number of wash tubes which form a set of wash arms, wherein the large number of wash tubes is connected to a corresponding wash pump by means of a preferably common line system.

Although not illustrated in the drawings, each wash zone (pre-wash zone 11, main-wash zone 12, post-wash zone 13) has an associated tank (wash tank) in which sprayed liquid is accommodated, and/or in which liquid is provided for the spray nozzles of the relevant zones 11, 12, 13.

The term "wash zone" used in this document is intended to be understood to mean, in principle, a treatment zone which has an associated recirculation tank (wash tank) and in which the liquid which is collected in the recirculation tank of the treatment zone is recirculated with the aid of a wash pump associated with the treatment zone. The term "wash zone" therefore covers the wash zone 11, the main-wash zone 12, but also a post-wash zone 13 which may be arranged downstream of the main-wash zone 12 as seen in the conveying direction T of the washware. The post-wash zone 13 is sometimes also referred to as a "pump final rinse zone" or "pre-rinse zone" in the field of commercial dishwashing. This is a recirculation final rinsing which precedes final rinsing with fresh water.

In contrast, the term "final rinse zone" used in this document is intended to be understood to mean a zone in which final rinsing with fresh water takes place, in which final rinsing the washware is sprayed with fresh water, to which final rinse aid may have been added, in order to free the washware of particles of dirt and detergent solution without residues.

In the exemplary embodiments illustrated in the drawings, the last rinsing cycle prior to drying in the drying zone 15 therefore takes place in the final rinse zone 14. The drying zone 15 has an associated corresponding fan (not illustrated in the drawings) in order to provide a flow of warm air around the already cleaned washware and as a result to dry said washware.

Furthermore, a control device 50 which is only schematically illustrated in the drawings is provided, said control device serving (inter alia), in the case of the embodiment of the invention illustrated in the drawings, to actuate the respective wash pumps of the wash zones 11, 12, 13 during a washing process in a suitable manner in order to at least occasionally supply wash liquid to the corresponding spray nozzles by means of the associated line system.

In the case of the conveyor dishwasher 1 illustrated in FIG. 1, final rinse liquid in the form of fresh water, to which further chemical additives, such as final rinse aid for example, may have been added, is sprayed onto the washware (not illustrated in FIG. 1) by means of the spray nozzles 2, which are arranged above and below a conveyor belt, of the final rinse zone 14. Although likewise not illustrated, laterally arranged spray nozzles can also be provided in the final rinse zone 14.

Some of the final rinse liquid which is sprayed in the final rinse zone 14 is transported from zone to zone, counter to the conveying direction T of the washware, by means of a cascade system. The rest is routed directly into the pre-wash tank of the pre-wash zone 11 by means of a valve and a bypass line (not illustrated).

The final rinse liquid which is sprayed in the final rinse zone 14 is collected in the tank (post-wash or pre-rinse tank) of the post-wash or pre-rinse zone 13, from which it is conveyed by means of the wash pump belonging to the wash system of the post-wash or pre-rinse zone 13 to the spray nozzles 3 (post-wash or pre-rinse nozzles) of the post-wash or pre-rinse zone 13. Wash liquid is rinsed off the washware in the post-wash or pre-rinse zone 13.

The liquid which is produced in the process flows into the wash tank of the main-wash zone 12, is usually provided with a detergent and is sprayed onto the washware with the aid of a wash pump which belongs to the wash system of the main-wash zone 12 by means of spray nozzles (wash nozzles 4) of the wash system which belongs to the main-wash zone 12.

From the wash tank of the main-wash zone 12, the wash liquid subsequently flows into the pre-wash tank of the pre-wash zone 11. In the pre-wash zone 11, the wash liquid which is collected in the pre-wash tank is sprayed onto the washware with the aid of a wash pump which belongs to the wash system of the pre-wash zone by means of spray nozzles (pre-wash nozzles 5) of the wash system which belongs to the pre-wash zone 11, in order to remove coarse dirt from the washware.

In this case, it is feasible for some of the wash liquid which is sprayed in the main-wash zone 12 to pass into the wash tank (pre-wash tank) of the pre-wash zone 11 by means of an overflow system. Like the main-wash zone 12, the pre-wash zone 11 can be equipped with a tank covering sieve in the form of a planar sieve. This tank covering sieve is preferably arranged above the wash tank (pre-wash tank) of the pre-wash zone 11 in order to separate particles of dirt from the wash liquid which is sprayed in the pre-wash zone 11 and flows back into the pre-wash tank due to gravity. The mesh width of the tank covering sieve preferably lies in a range of between approximately 1 mm and 4 mm.

Clouds of steam (vapor) are produced owing to the heated wash and final rinse liquid when the latter are sprayed within the wash and final rinse zones 11, 12, 13, 14 of the conveyor dishwasher 1. In order to prevent these clouds of steam from exiting from the conveyor dishwasher 1, it is advantageous, in the embodiment schematically illustrated in FIG. 1, when the individual treatment zones and in particular the wash and final rinse zones 11, 12, 13, 14 are separated off by curtains 6.

In order to discharge the clouds of steam (vapor) which are produced during operation of the conveyor dishwasher 1 and also humid, warm air from the interior of the conveyor dishwasher 1, it is feasible to equip the conveyor dishwasher 1 with a machine-side waste air system which is designed to discharge at least the majority of the warm and humid air which is produced in the treatment zones 11, 12, 13, 14 during operation of the conveyor dishwasher 1 as waste air out of the respective treatment zones 11, 12, 13, 14 of the machine.

In the case of the exemplary embodiment of the conveyor dishwasher 1 according to the invention illustrated in the drawings, a detection system 30 is used, said detection system having a rack entry switch/rack entry sensor 31 which is arranged in a predefined region A at the inlet 10 or feed 16 of the conveyor dishwasher 1 and is designed in order to detect the presence of washware or a washware carrier 7 there. This rack entry switch/rack entry sensor 31 may be, for example, an optical, capacitive or inductive system, a light scanner or reed sensor, or a mechanical switch. However, it goes without saying that another kind of sensor system or the like can also be used.

The conveyor dishwasher 1 schematically illustrated in the drawings is a rack conveyor dishwasher in which the washware (not explicitly illustrated)—placed in dish carriers 7 or dish racks—is pushed from a feed 16 (feed table) into the inlet 10 (inlet channel) and, respectively, into the conveyor dishwasher 1 and there conveyed through the individual treatment zones 11, 12, 13, 14, 15 with the aid of the conveyor apparatus 20. However, it goes without saying that the invention is not restricted to rack conveyor dishwashers of this kind, but rather can also be used, in general, with other types of machine, in particular flight-type dishwashers.

The rack entry switch/rack entry sensor 31 which is provided in the region A at the inlet 10 or feed 16 of the conveyor dishwasher 1 is initiated when a washware carrier 7 (dish rack) which may be holding washware is placed into the inlet 10 or feed 16 of the conveyor dishwasher 1.

According to the invention, the detection system 30 is connected to a control device 50, which is only schematically illustrated in the drawings, in such a way that the control device 50 actuates the conveyor apparatus 20 of the conveyor dishwasher 1 depending on whether washware or a washware carrier 7 is present in the region A at the inlet 10 or feed 16 of the conveyor dishwasher 1. In this case, it is particularly provided that the conveyor apparatus 20 is activated with the aid of the control device 50 when washware or a washware carrier 7 is detected in the region A at the inlet 10 or feed 16 of the conveyor dishwasher 1 with the aid of the rack entry switch/rack entry sensor 31. In other words, the conveyor apparatus 20 of the conveyor dishwasher 1 is activated with the aid of the control device 50 when the rack entry switch/rack entry sensor 31 which is provided at the inlet 10 or feed 16 of the conveyor dishwasher 1 is initiated or triggered by a washware carrier 7 (dish rack).

Secondly, the rack entry switch/rack entry sensor 31 of the detection system 30, which rack entry switch/rack entry sensor is provided at the inlet 10 or feed 16 of the conveyor dishwasher 1, is designed to output a corresponding signal to the detection system 30 or the control device 50 when it is detected that there is no (longer) washware or a washware carrier 7 in the region A at the inlet 10 or feed 16 of the conveyor dishwasher 1. During buffer operation of the conveyor dishwasher, the control device 50 then actuates the conveyor apparatus 20 in such a way that the conveyor apparatus 20 is deactivated.

In the case of the embodiment of the conveyor dishwasher 1 according to the invention schematically illustrated in the drawings, the detection system 30 further has a buffer switch/buffer sensor 32 which is provided in a predefined region B at the outlet 17 of the conveyor dishwasher 1. This buffer switch/buffer sensor 32 can—like the rack entry switch/rack entry sensor 31 which is provided at the inlet 10 or feed 16 of the conveyor dishwasher 1—be designed as an optical, capacitive or inductive system. Furthermore, mechanically operated switches, reed switches or other types of switches, for example, can also be used.

In general, the buffer switch/buffer sensor 32 which is provided in the predefined region B at the outlet 17 of the conveyor dishwasher 1 serves to detect whether washware or a washware carrier 7 is present in this region B. If this is the case, the buffer switch/buffer sensor 32 outputs a corresponding signal to the detection system 30, as a result of which the control device 50 actuates the conveyor apparatus 20 in a corresponding manner.

Furthermore, at least one further switch/sensor which is likewise associated with the detection system 30 and is designed, in particular, as an end switch/end sensor 33 is used in the exemplary embodiment of the conveyor dishwasher 1 according to the invention illustrated in the drawings. As indicated in the drawings, this end switch/end sensor 33 is arranged in a predefined region within the end region C of the outlet 17 of the conveyor dishwasher 1 in order to detect the presence of washware or a washware carrier 7 there. The end switch/end sensor 33 is preferably an optically, capacitively or inductively operating system, or else a switch, in particular a mechanically operated switch, which is triggered when washware or a washware carrier 7 is pushed into the outlet 17 of the conveyor dishwasher 1 until the washware or the washware carrier 7 reaches the active region of the end switch/end sensor 33.

As indicated in the drawings, the outlet 17 of the conveyor dishwasher 1 is dimensioned in such a way that it can receive at least two washware carriers 7 one behind the other as seen in the conveying direction T of the conveyor apparatus 20. Usual dimensions of the outlet 17 of a conveyor dishwasher 1 lie between 700 mm and 2000 mm.

The feed 16 of the conveyor dishwasher 1, pre-clearing possibly also being performed in the region of said feed and said feed generally serving for loading washware carriers 7 (for example washware racks) with washware, is usually dimensioned in a similar manner to the outlet 17 and can receive at least two standard washware carriers 7. Usual dimensions of the feed 16, which is designed in the form of a feed table for example, lie in the range of between 700 mm and 2000 mm.

The schematic illustrations in the drawings further show that the rack entry switch/rack entry sensor 31 of the detection system 30 is preferably arranged in a region A at the inlet 10 of the conveyor dishwasher 1, the conveyor apparatus 20 already being active in said region. This is intended to be understood to mean, in particular, that, in a case when washware or a washware carrier 7 is situated in the active region of the rack entry switch/rack entry sensor 31, this washware or this washware carrier 7 is conveyed in conveying direction T when the conveyor apparatus 20 is active.

In contrast, the buffer switch/buffer sensor 32 of the detection system 30 is arranged in a region B at the outlet 17 of the conveyor dishwasher 1, and preferably—as indicated in the drawings—in a region of the outlet 17 of the conveyor dishwasher 1 which is no longer in the active region of the conveyor apparatus 20 of the conveyor dishwasher 1. This buffer switch/buffer sensor 32 is usually arranged 0 to 500 mm, and preferably 100 to 300 mm, downstream of the beginning of the outlet.

The end switch/end sensor 33 which also belongs to the detection system 30 is arranged in the end region C, and preferably immediately at the end of the outlet 17.

The interaction of the detection system 30 with the control device 50 and the conveyor apparatus 20 of the conveyor dishwasher 1 according to the invention will be described in greater detail below with reference to the illustrations in the drawings.

Specifically, in the case of the exemplary embodiment of the conveyor dishwasher 1 schematically illustrated in the drawings, it is provided that said conveyor dishwasher can be operated in at least two operating modes. The first operating mode, which is also called the "first operating state" in this document, in this case represents a standard situation in which the washware carrier 7 is transported through the individual treatment zones 11, 12, 13, 14, 15 of the conveyor dishwasher 1 without the conveyor apparatus 20 stopping.

However, as soon as the buffer switch/buffer sensor 32 is initiated at the outlet 17 of the conveyor dishwasher 1, that is to say when, for example, a washware carrier 7 operates the buffer switch/buffer sensor 32 at the interface between the conveyor dishwasher 1 and the outlet 17 which is designed, for example, as an outlet table, the conveyor apparatus 20 of the conveyor dishwasher 1 is deactivated by means of the control device 50, and therefore transportation of the washware carriers 7 through the treatment zones 11, 12, 13, 14, 15 of the conveyor dishwasher 1 is interrupted. The conveyor dishwasher 1 is switched over to the second operating mode ("buffer operation") by the buffer switch/buffer sensor 32 being triggered/operated.

In this second operating mode, which is also called the "second operating state" or "buffer operation" in this document, the conveyor apparatus 20 is activated by means of the control device 50 only when the rack entry switch/rack entry sensor 31 at the inlet 10 or feed 16 of the conveyor dishwasher 1 is covered by a washware carrier 7 or washware. In other words, the conveyor apparatus 20 is activated in the second operating mode (buffer operation) only when new washware, such as a new washware carrier 7 for example, is introduced into the dishwasher. As a result, the washware is transported as seen in the conveying direction T until the washware is no longer in the active region of the rack entry switch/rack entry sensor 31.

In the second operating mode (buffer operation), the conveyor apparatus 20 is—as already discussed—only activated when the rack entry switch/rack entry sensor 31 is covered. As soon as the washware or the washware carrier 7 has been transported out of the active region of the rack entry switch/rack entry sensor 31, the conveyor apparatus 20 is deactivated.

As a result of this, no new spaces are created between the washware or the washware carriers 7 in the region downstream of the rack entry switch/rack entry sensor 31 (as seen in conveying direction T of the washware), as a result of which the length of the dishwasher can be utilized more efficiently as a rack buffer. This is schematically illustrated in FIG. 2 in particular.

The above-described second operating mode (buffer operation) is deactivated again by the washware or the washware carriers 7 being unloaded at the outlet 17 of the conveyor dishwasher 1. This can be performed, for example, by the end switch/end sensor 33 being triggered or by the buffer switch/buffer sensor 32 being cleared. The conveyor apparatus 20 is then activated again without interruption with the aid of the control device 50, specifically at least until all of the washware or all of the washware carriers 7 have been conveyed through the treatment zones 11, 12, 13, 14, 15 of the conveyor dishwasher 1.

Renewed buffer operation (that is to say a changeover to the second operating mode) is preferably made possible again only when washware or a washware carrier 7 is pushed into an empty dishwasher and said washware or washware carrier then reaches the buffer switch/buffer sensor 32.

Accordingly, it should be noted that the unloading behavior of the conveyor dishwasher 1 can be monitored by the detection system 30 or the buffer switch/buffer sensor 32 of the detection system 30. Additional information relating to the loading behavior is available in combination with the rack entry switch/rack entry sensor 31. Intelligent control of the conveyor apparatus 20 is made possible by combining the two items of information.

Therefore, it is possible to make optimum use of, in particular, the machine length in the event of operation by only one single member of dishwashing staff, that is to say the number of washware carriers 7 or the number of washware units is maximized when loading the conveyor dishwasher 1. Owing to loading without gaps, a greater number of washware carriers 7 or more washware units can be loaded into the conveyor dishwasher 1 before the dishwashing personnel have to unload the conveyor dishwasher 1. In addition, unloading in the event of operation by only one single member of dishwashing staff can be made convenient, specifically owing to interruption-free conveying during the unloading process.

Furthermore, no disadvantages arise in the event of operation by two or more persons since conveying through the individual treatment zones 11, 12, 13, 14, 15 of the conveyor dishwasher 1 proceeds without interruption in this case too.

Therefore, both the advantages of continuous conveying (first operating mode) and the advantages of buffer operation (second operating mode) are used owing to the information about the loading behavior, and this is done so without the disadvantages of these two operating modes.

Although not illustrated in the drawings, it is advantageous in a preferred development of the conveyor dishwasher 1 according to the invention when the control device 50 is designed to activate the conveyor apparatus 20 with a time delay when washware or a washware carrier 7 is detected in the region at the inlet 10 or feed 16 of the conveyor dishwasher 1.

Accordingly, it is possible for the conveyor dishwasher 1 to be designed to also deactivate the corresponding wash and final rinse systems (switch off the corresponding wash and final rinse pumps) in a state in which the conveyor apparatus 20 is deactivated, that is to say when no washware is transported through the individual treatment zones 11, 12, 13, 14, 15 of the conveyor dishwasher 1, in order to thereby save resources (energy, fresh water, chemicals) in the deactivated state of the conveyor apparatus 20. Delayed activation of the conveyor apparatus 20 has the result that a certain "lead time" is cleared for the wash and final rinse systems of the conveyor dishwasher 1 in order to be able to build up the nozzle pressure which is required for effective treatment of the washware.

The time delay in activating the conveyor apparatus 20 is preferably manually adjustable and lies in a range of between 0 and 10 s.

Furthermore, it is advantageous when the control device 50 is designed to deactivate the conveyor apparatus 20 only when no washware is detected in the region at the inlet 10 or feed 16 of the conveyor dishwasher 1 for a certain time. This time is also preferably manually adjustable and amounts to between 0 and 10 s.

The invention relates not only to a conveyor dishwasher 1 but also to a corresponding method for operating a conveyor dishwasher 1. This method is distinguished, in particular, by the following method steps:

i) a detection system 30 is used to detect whether washware or a washware carrier 7 is present in a region A at the inlet 10 or feed 16 of the conveyor dishwasher 1; and ii) a control device 50 is used to activate the conveyor apparatus 20 of the conveyor dishwasher 1 when washware or a washware carrier 7 is detected in the region A at the inlet 10 or feed 16 of the conveyor dishwasher 1, and to deactivate said conveyor apparatus when no washware or no washware carrier 7 is detected in the region A at the inlet 10 or feed 16 of the conveyor dishwasher 1.

The method preferably further comprises the following method steps:

the detection system 30 is used to detect whether washware or a washware carrier 7 is present in a region B at the outlet 17 of the conveyor dishwasher 1; and the control device 50 is used to activate the conveyor apparatus 20 when washware or a washware carrier 7 is respectively detected in the region A at the inlet 10 or feed 16 of the conveyor dishwasher 1 and in the region B at the or in the outlet 17 of the conveyor dishwasher 1, and to deactivate said conveyor apparatus when no washware or no washware carrier 7 is detected in the region A at the inlet 10 or feed 16 of the conveyor dishwasher 1 and washware or a washware carrier is detected in the region B at the or in the outlet 17 of the conveyor dishwasher 1.

The method preferably further comprises the following method steps:

the detection system 30 is used to detect whether washware or a washware carrier 7 is present within an end region C of the outlet 17 of the dishwasher; and the control device 50 is used to activate the conveyor apparatus 20 when washware or a washware carrier 7 is respectively detected in the region A at the inlet 10 or feed 16 of the conveyor dishwasher 1 and in the region B at the or in the outlet 17 of the conveyor dishwasher 1 and when additionally no washware or no washware carrier 7 is detected in the region within the end region C of the outlet 17 of the conveyor dishwasher 1, and to deactivate said conveyor apparatus when no washware or no washware carrier 7 is detected in the region A at the inlet 10 or feed 16 of the conveyor dishwasher 1 and washware or a washware carrier 7 is detected in the region B at the or in the outlet 17 of the conveyor dishwasher 1.

The invention is not restricted to the embodiment which is described in connection with the drawings, but rather can be gathered by looking at all of the features disclosed in this document together.

The invention claimed is:

1. A conveyor dishwasher having a conveyor apparatus for conveying washware through multiple treatment zones of the conveyor dishwasher, wherein the conveyor dishwasher has a detection system which is designed to detect the presence of washware or a washware carrier in a first predefined region at an inlet or at a feed of the conveyor dishwasher; and wherein a control device is provided, said control device being designed to actuate the conveyor apparatus in such a way that:

the conveyor apparatus is activated when washware or a washware carrier is detected in the first predefined region at the inlet or feed of the conveyor dishwasher; and the conveyor apparatus is deactivated when no washware or no washware carrier is detected in the first predefined region at the inlet or feed of the conveyor dishwasher;

where the detection system is further designed to detect the presence of washware or a washware carrier in a second predefined region at an outlet of the conveyor dishwasher, and where the control device is further designed to actuate the conveyor apparatus depending on whether washware or a washware carrier is present in the second predefined region at the outlet of the conveyor dishwasher;

where the control device is designed, in a first operating state of the conveyor dishwasher, to activate the conveyor apparatus independently of whether washware or a washware carrier is present in the first predefined region at the inlet or in the feed of the conveyor dishwasher and, in a second operating state of the conveyor dishwasher, to actuate the conveyor apparatus in such a way that:

the conveyor apparatus is activated when washware or a washware carrier is respectively detected in the first predefined region at the inlet or feed of the conveyor dishwasher and in the second predefined region at the or in the outlet of the conveyor dishwasher; and the conveyor apparatus is deactivated when no washware or no washware carrier is detected in the first predefined region at the inlet or feed of the conveyor dishwasher and an item of washware or a washware carrier is detected in the second predefined region at the or in the outlet of the conveyor dishwasher;

where the control device is designed to automatically switch over from the second operating state of the conveyor dishwasher to the first operating state when it is detected with the aid of the detection system that washware which was previously present at the or in the outlet of the conveyor dishwasher or the washware carrier which was previously present at the or in the outlet of the conveyor dishwasher has been removed.

2. The conveyor dishwasher as claimed in claim 1, where the outlet of the conveyor dishwasher directly follows the conveyor apparatus—as seen in a conveying direction of the washware —, and where the detection system is designed to detect the presence of washware or a washware carrier in the second predefined region of the outlet of the conveyor dishwasher, and where the control device is further designed to actuate the conveyor apparatus depending on whether washware or a washware carrier is present in the second predefined region of the outlet of the conveyor dishwasher.

3. The conveyor dishwasher as claimed in claim 2, where the outlet of the conveyor dishwasher is designed to receive multiple washware units and/or washware carriers, where the second predefined region of the outlet, in which region the presence of washware or a washware carrier can be detected with the aid of the detection system, lies upstream of an end region of the outlet as seen in the conveying direction of the washware.

4. The conveyor dishwasher as claimed in claim 2, where the second predefined region of the outlet, in which the presence of washware or a washware carrier can be detected with the aid of the detection system, lies between 100 to 300 mm, downstream of the beginning of the outlet as seen in the conveying direction of the washware.

5. The conveyor dishwasher as claimed in claim 1, where the first predefined region at the inlet or feed of the conveyor dishwasher, in which region the presence of washware or a washware carrier can be detected with the aid of the detection system, lies in an inlet tunnel of the conveyor dishwasher.

6. Conveyor dishwasher as claimed in claim 1, where the control device is designed, in the first and in the second operating state of the conveyor dishwasher, to activate the conveyor apparatus when it is detected with the aid of the detection system that washware or a washware carrier is present at the inlet or feed of the conveyor dishwasher.

7. Conveyor dishwasher as claimed in claim 6, where the detection system is further designed to detect the presence of washware or a washware carrier in a further region which was predefined within the end region of the outlet, and where the control device is further designed to actuate the conveyor apparatus in such a way that, in the second operating state of the conveyor dishwasher:

the conveyor apparatus is activated when washware or a washware carrier is respectively detected in the first predefined region at the inlet or feed of the conveyor dishwasher and in the second predefined region at the or in the outlet of the conveyor dishwasher, and when additionally no washware or no washware carrier is detected in the further region within the end region of the outlet of the conveyor dishwasher; and the conveyor apparatus is deactivated when no washware or no washware carrier is detected in the first predefined region at the inlet or feed of the conveyor dishwasher and washware or a washware carrier is detected in the second predefined region at the or in the outlet of the conveyor dishwasher.

8. The conveyor dishwasher as claimed in claim 7, where the control device is further designed to actuate the conveyor apparatus in such a way:

that the conveyor apparatus is deactivated when washware or a washware carrier is detected in the further region within the end region of the outlet; or that the conveyor apparatus is deactivated when washware or a washware carrier is respectively detected in the second predefined region at the or in the outlet of the conveyor dishwasher and in the further region within the end region of the outlet.

9. The conveyor dishwasher as claimed in claim 8, where the control device is designed to automatically switch over from the second operating state of the conveyor dishwasher to the first operating state when it is detected by the detection system that washware which was previously present in the end region of the outlet of the conveyor dishwasher or the washware carrier which was previously present in the end region of the outlet of the conveyor dishwasher has been removed, or that no washware or no washware carrier is present in the second predefined region at the or in the outlet of the conveyor dishwasher.

10. The conveyor dishwasher as claimed in claim 9, where the control device is designed to automatically switch over from the first operating state of the conveyor dishwasher to the second operating state when it is detected with the aid of the detection system that washware or a washware carrier is present in the second predefined region at the or in the outlet of the conveyor dishwasher, and that no washware or no washware carrier was present in the second predefined region at the or in the outlet of the conveyor dishwasher before the presence of the detected washware or of the detected washware carrier at least for a defined time which reflects the time taken to convey an item of washware through the multiple treatment zones of the conveyor dishwasher.

11. The conveyor dishwasher as claimed in claim 1, where the detection system has at least one optical, capacitive or inductive sensor and/or switch.

12. The conveyor dishwasher as claimed in claim 1, where the control device is designed to activate or to deactivate the conveyor apparatus with a time delay depending on a loading state of the conveyor dishwasher, which loading state is detected with the aid of the detection system.

13. The conveyor dishwasher as claimed in claim 12, where the control device is designed to activate the conveyor apparatus with a time delay when washware or a washware carrier is detected in the first predefined region at the inlet or feed of the conveyor dishwasher, and/or to deactivate the conveyor apparatus when no washware or no washware carrier is detected in the first predefined region at the inlet or feed of the conveyor dishwasher for a certain time.

14. A conveyor dishwasher, comprising:

a conveyor apparatus for conveying washware through multiple treatment zones of the conveyor dishwasher;

a detection system configured to detect the presence of washware or a washware carrier in a first predefined region at an inlet or at a feed of the conveyor dishwasher and to detect the presence of washware or a washware carrier in a second predefined region at an outlet of the conveyor dishwasher; and a control device configured to control activation of the conveyor apparatus, wherein the control device is configured to control activation of the conveyor apparatus differently as between a first operating state and a second operating state of the conveyor dishwasher, in the first operating state the control device activates the conveyor apparatus independently of whether washware or a washware carrier is present in the first predefined region at the inlet or in the feed of the conveyor dishwasher and, in the second operating state the control device actuates the conveyor apparatus in such a way that both:

(i) the conveyor apparatus is activated when washware or a washware carrier is respectively detected in both the first predefined region at the inlet or feed of the conveyor dishwasher and in the second predefined region at the or in the outlet of the conveyor dishwasher;

and (ii) the conveyor apparatus is deactivated when no washware or no washware carrier is detected in the first predefined region at the inlet or feed of the conveyor dishwasher and an item of washware or a washware carrier is detected in the second predefined region at the or in the outlet of the conveyor dishwasher.

15. The conveyor dishwasher of claim 14, wherein the second predefined region is at an upstream end of the outlet, as seen in a conveyance direction of the conveyor apparatus.

16. The conveyor dishwasher of claim 15 wherein the outlet is formed by an outlet table downstream of the conveyor apparatus.

17. A conveyor dishwasher, comprising:

a conveyor apparatus for conveying washware through multiple treatment zones of the conveyor dishwasher;

a detection system configured to detect the presence of washware or a washware carrier in each of (i) a first predefined region at an inlet or at a feed of the conveyor dishwasher and (ii) a second predefined region of an outlet of the conveyor dishwasher, wherein the second predefined region is at an upstream end of the outlet, as seen in a conveyance direction of the conveyor apparatus; and a control device associated with the detection system and configured to control the conveyor apparatus based upon each of:

(i) detection of washware or a washware carrier in the first predefined region, and (ii) detection of washware or a washware carrier in the second predefined region;

wherein the detection system is also configured to detect the presence of washware or a washware carrier in (iii) a third predefined region of the outlet of the conveyor dishwasher, wherein the third predefined region is at a downstream end of the outlet, as seen in the conveyance direction;

wherein the control device is also configured to control the conveyor apparatus based upon (iii) detection of washware or a washware carrier in the third predefined region.

18. The conveyor dishwasher of claim 17, wherein the control device is configured such that:

(a) the conveyor apparatus is activated when washware or a washware carrier is detected in both the first predefined region and in the second predefined region, but no washware or washware carrier is detected in the third predefined region of the outlet of the conveyor, and (b) the conveyor apparatus is deactivated whenever washware or a washware carrier is detected in the third predetermined region.

* * * * *